US008955608B1

(12) United States Patent
Christopulos

(10) Patent No.: US 8,955,608 B1
(45) Date of Patent: Feb. 17, 2015

(54) ACCOMMODATING HAZARD MITIGATION SYSTEMS IN FLUID GUIDES

(75) Inventor: Emily B. Christopulos, Mountain Green, UT (US)

(73) Assignee: Windchill Engineering, Inc., Orem, UT (US)

( * ) Notice: Subject to any disclaimer, the term of this patent is extended or adjusted under 35 U.S.C. 154(b) by 899 days.

(21) Appl. No.: 13/164,628

(22) Filed: Jun. 20, 2011

Related U.S. Application Data

(60) Provisional application No. 61/356,558, filed on Jun. 19, 2010.

(51) Int. Cl.
*A62C 2/00* (2006.01)

(52) U.S. Cl.
USPC ..... 169/46; 169/45

(58) Field of Classification Search
CPC ..... A62C 3/14; A62C 4/00; A62C 4/02; A62C 37/04; A62C 37/10
USPC ..... 169/45, 46, 19, 54; 239/569, 570, 578
See application file for complete search history.

(56) References Cited

U.S. PATENT DOCUMENTS 5,154,238 A * 10/1992 Buchan ..... 169/62
6,311,781 B1 * 11/2001 Jerke ..... 169/62
7,063,516 B2 * 6/2006 Bethel ..... 417/395

* cited by examiner

*Primary Examiner* — Davis Hwu
(74) *Attorney, Agent, or Firm* — Maschoff Brennan

(57) ABSTRACT

In an embodiment, a method of accommodating a hazard mitigation system in a system including one or more fluid guides is described. The method includes forming a one-way valve in at least one of the one or more fluid guides. The one-way valve may be configured to substantially prevent the egress of fluid from the at least one of the one or more fluid guides through the one-way valve. The one-way valve may be further configured to allow ingress of a neutralizing agent supplied by a source outside the at least one of the one or more fluid guides through the one-way valve.

12 Claims, 5 Drawing Sheets

ACCOMMODATING HAZARD MITIGATION SYSTEMS IN FLUID GUIDES

CROSS-REFERENCE TO RELATED APPLICATIONS

This application claims the benefit of and priority to U.S. Provisional Patent Application No. 61/356,558, filed Jun. 19, 2010 and entitled METHOD FOR ACCOMMODATING FIRE SUPPRESSION AND DETECTION SYSTEMS INTO DUCTS. The foregoing application is herein incorporated by reference in its entirety.

BACKGROUND

1. Field of the Invention

Embodiments described herein generally relate to hazard mitigation in fluid guides such as ducts. More particularly, some example embodiments relate to techniques for confining fluids within a fluid guide while allowing neutralizing agents to enter and/or pass through the fluid guide when a risk is detected.

2. Related Technology

Fluid guides, such as barriers or ducts, may be implemented in data centers to efficiently guide liquid or gas coolants to computer servers or other heat-generating equipment to cool such equipment. In some cases, however, the placement of fluid guides may interfere with fire suppression systems such that some data center manages may choose to not implement fluid guides at the expense of reduced cooling efficiency.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

Embodiments described herein generally relate to accommodating hazard mitigation systems in systems that include one or more fluid guides.

In an example embodiment, a method of accommodating a hazard mitigation system in a system including one or more fluid guides is described. The method includes forming a one-way valve in at least one of the one or more fluid guides. The one-way valve may be configured to substantially prevent the egress of fluid from the at least one of the one or more fluid guides through the one-way valve. The one-way valve may be further configured to allow ingress of a neutralizing agent supplied by a source outside the at least one of the one or more fluid guides through the one-way valve.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

These and other aspects of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figure 1:
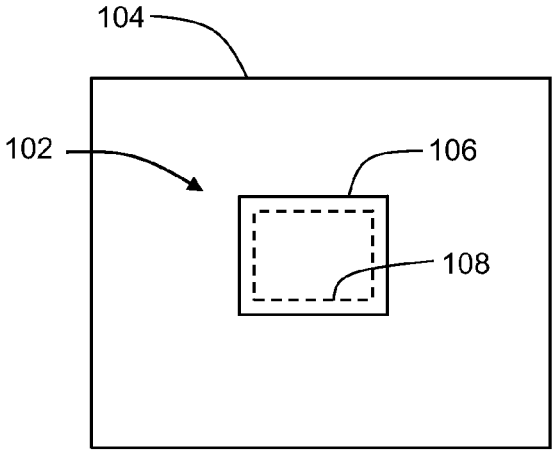
FIG. 1 illustrates a one-way valve formed in a fluid guide.

all arranged in accordance with at least some embodiments described herein.

DETAILED DESCRIPTION OF SOME EXAMPLE EMBODIMENTS

Some embodiments described herein relate to systems, devices and methods of accommodating hazard mitigation in connection with fluid guides such as ducts that define isolated and/or semi-isolated areas. In an embodiment, a one-way valve is formed in a duct or other fluid guide that is configured to prevent transported fluid from escaping a corresponding channel system while allowing a neutralizing agent to enter and/or pass through the duct or partitioned area when a risk is detected. Example environments including fluid guides in which such one-way valves can be implemented include, but are not limited to, industrial and residential buildings, including gymnasiums and data centers.

By way of example, data centers are rooms or buildings specifically dedicated to data processing and storage devices. More particularly, a data center as used herein refers to a room or building that houses one or more server units. Data centers may be found in nearly every sector of the economy: financial services, media, high-tech, universities, and government institutions.

The data center industry is enjoying a major growth period stimulated by increasing demand for data processing and storage. This increasing demand is driven by several factors, including but not limited to: increased use of electronic transactions for banking, communication and entertainment; a shift toward electronic record-keeping; and adoption of satellite navigation. As companies that support these trends develop and grow, the business surrounding the security and efficiency of data processing also grows.

Due to an increased awareness of the limits of our planet, some areas of particular interest to building maintenance professionals, building owners and scientists are power and airflow usage efficiency in data centers. A significant amount of power is consumed by running and cooling server units in data centers worldwide. The EPA estimates that the USA's consumption of power in running and cooling server units equals the output of three smaller, but developed countries. As such, there is a need for any process, product or service that can reduce the energy demands of processing and storing data.

One area of great interest to engineers and professionals in data center facilities is the underfloor plenum area. In particular, a raised floor access system may be used in data centers in order to offer a place to store wires and other equipment, as well as a route for directing cold air from wall-mounted cooling units through perforated tiles to fronts of servers that become heated as they process data loads.

However, problems in airflow predictability and efficiency in raised floor access systems have been noticed by engineers and managers for many years. Namely, small vortexes or barricades are created when air swirls around equipment and wire trays in the access floor plenum, diffusing chilled air in places it is not needed and possibly preventing it from reaching the perforated tiles at an optimal velocity. The end result is air moving too slowly through perforated tiles, which may mean an increase in cubic feet per minut (cfm) through perforations ("Bernoulli effect"), resulting in an overcooling of the area. In some scenarios, the expected cooling load doesn't even arrive at its intended destination, resulting in places where air is intended to be delivered, but is not. Consequently, there is an increased demand for maintenance and re-engineering.

There are several methods and ways of balancing the issue of available cooling load vs. delivery of chilled load, including moving equipment from the floor to above the ceiling in order to avoid the creation of odd and inefficient airflow patterns. However, this does not completely eliminate the issue in most data centers because the remaining plenum space is not optimally designed. For instance, traditional corners of a square or rectangular room "trap" air. Additionally, the open floor plenum may be of a much larger area than an area vented by perforated tiles.

In many scenarios, customers continue to prefer to house equipment in under-floor storage areas, often against the advice of skilled engineers, largely because under floor storage provides a clean look and convenient access to equipment. In other words, data center customers, when given no alternative, may choose to endure the cost of excess power consumption due to the creation of inefficient air patterns created by the convenience of storing equipment in the access floor.

One solution includes offering a "tiered" flooring system. For example, one "layer" of flooring may be used for equipment storage and another "layer" of flooring may be used for air delivery.

Other factors that may contribute to the air delivery problem are: the absence of Variable Frequency fans on HVAC units, the square and open nature of the floor "plenum", the general lack of knowledge of details of airflow science by practitioners in the field, and the lack of presence of an engineer specializing in airflow issues relative to equipment placement in the design phase of building the facilities.

Solutions to the airflow delivery issues created by access floor plenums in data centers may include, but are not limited to: 1) active fans that direct stagnant air toward perforated tiles, either at the cooling unit level and/or along the underfloor air plenum "route"; 2) modified tiles that adjust air intake either passively or actively; 3) modified cabinet doors that passively or actively improve cooling or add to the cooling process; 4) cold or hot aisle containment; 5) ducting or partitioning air in more desirable patterns; and 6) improving the recapture of air through return air plenums in order to maximize the cooling capacity of the unit.

In some embodiments, improved cooling efficiency of mounted cooling units is provided by partitioning or ducting air in order to prevent air from being wasted in areas where it is not needed (e.g., areas other than at the base of perforated tiles). Many methods of directing air underfloor have been introduced in the data center, including mounting cooling units behind sheet rock to avoid a perimeter that cannot easily be integrated into a "cool room". This technique may include extending the sheet rock into the subfloor plenum and around cooling unit exhaust pipes. Isolating areas of use (separating areas where servers needing cooling are located from other equipment in the data center) with plastic, metal, sheet rock or fabric partitions may also be part of the troubleshooting process. In some layouts, this technique may be combined with perforating the partition in order to manipulate velocity to a desired speed.

In these and other embodiments, accommodation of certain hazard mitigation systems in underfloor plenum areas or other areas can permit implementation of barriers, ducts or other fluid guides in compliance with fire codes and/or other building standards. One example hazard mitigation system is a fire detection and suppression system. It is common for fire detection/suppression systems in the industry to talk in batches, or groups, of, for instance, 3 or 5 units. In other words, groups of sensors relay information to one another about the temperature in a certain area to determine whether or not to sound an alert and/or deploy a fire suppression gas to mitigate a developing fire.

Although it is beneficial, at least from the standpoint of cooling efficiency, to implement barriers, ducts, and/or other fluid guides to guide air more effectively to servers, the ability of the expensive and necessary fire mitigation equipment to effectively operate can be compromised by poor placement of the fluid guides. For instance, a barrier, duct or other fluid guide positioned between a source of neutralizing agent, such as fire suppressant, and a particular area can prevent the neutralizing agent from being delivered to the particular area, thereby defining an isolated or semi-isolated area. As such, many data centers have been opting for the expense of poor air delivery over a possible decrease in the effectiveness of a corresponding hazard mitigation system. Therefore, the problem of less than optimal functioning of cooling units and the associated expense of overproduction of cold air and/or inefficient use of chilled air remains an overconsumption issue in data centers worldwide. Sometimes, the unnecessary exhaustion of resources is noticed only if delivery of air to servers causes an immediate problem to the operating temperature of the server(s).

Nevertheless, proactive managers and owners wish to conserve energy whenever possible, so the fluid guide method of increasing efficiency of airflow delivery remains useful, either alone or in conjunction with other methods. In order to create a viable fluid guide product that can meet the demands of data centers, some embodiments described herein may ensure functioning of fluid/coolant delivery channels together with existing or future hazard mitigation systems. Hyper diligence, especially with regard to mitigating fire danger or other hazards to sensitive equipment, is desirable in the data center industry and the construction industry, in general.

Of course, careful placement of fluid guides in the facility design stage can eliminate problems ab initio and ensure that the fluid guides do not interfere with hazard mitigation systems. However, within a pre-existing data center, fluid guides can be implemented based on available knowledge of hazard mitigation systems by providing one or more one-way valves to accommodate the hazard mitigation systems. Alternately or additionally, some embodiments described herein may provide flexibility in installation options created by a full-coverage scenario of a "blow through" duct option created by the valve method.

Adapting underfloor fluid channels to work with fire suppression devices or other hazard mitigation devices may be beneficial for, e.g., older and pre-existing data centers. Older data centers often have the most serious airflow delivery issues, smaller plenums for air delivery, and more underfloor equipment. In these and other embodiments, a one-way valve, flap, or window may be provided that does not allow fluid egress in a daily use situation, but allows ingress of a neutralizing agent, such as fire suppression gases, into and across the fluid channel. By preventing or substantially preventing fluid egress in normal operation and allowing ingress of the neutralizing agent, the goals of both improved cooling efficiency and hazard mitigation may be met. Accordingly, some embodiments described herein may be useful as an add-on in any ducting building or other environment with fluid guides and with fire suppression systems for added risk mitigation.

The embodiments described herein can also be useful in fluid guides such as ceiling ducts in data centers and other types of fluid guides in any industrial or residential building. Fluid guides may include barriers, ducts, pipes or other devices generally configured to confine fluids to a particular path. Fluid guides may be located in/on the floor, wall, ceiling or other locations within the data center, as can heating and cooling units. The fluid guides may be configured to disperse and/or guide a fluid coolant, such as air or liquid, throughout a room and directly to desired locations, as in the configuration of perforated tiles at the base of computer servers. One or more mechanical cooling units may be provided in the data center to remove heat (e.g., thermal energy) from the fluid coolant that may be collected by the fluid coolant as it is circulated through the system.

Referring first to FIG. 1, a one-way valve 102 formed in a fluid guide 104 is illustrated, arranged in accordance with at least some embodiments described herein. The fluid guide 104 of FIG. 1 may include a 2 foot by 2 foot access floor air direction device. The one-way valve 102 in FIG. 1 may be a passive one-way valve including a flap 106 attached to the fluid guide 104 and covering an opening, denoted at 108, formed in the fluid guide 104. The flap 106 may be slightly larger than the opening 108. Each of the flap 106 and fluid guide 104 may include fabric, metal, or other material(s)

In general, the one-way valve 102 may be configured to substantially prevent the egress of fluid from the fluid guide 104 through the fluid guide 104 in one direction. For instance, the one-way valve 102 may be configured to prevent fluid (e.g., air, liquid, or other coolant—not shown in FIG. 1) present in front of the one-way valve 102 from passing through the one-way valve 102 from front-to-back. The one-way valve may be further configured to allow ingress of fire suppressant or other neutralizing agent supplied by a source outside the fluid guide 104 (e.g., behind the fluid guide 104 in the example of FIG. 1) through the one-way valve 102 from back to front.

While the fluid may be slightly pressurized, its pressurization is typically much less than that of the fire suppressant or other neutralizing agent. Accordingly, implementing a material having at least a predetermined minimum stiffness, making the flap 106 at least slightly oversized with respect to the opening 108, and/or attaching the flap 106 to the front of the fluid guide 104 can configure the flap 106 to substantially prevent the egress of fluid through the one-way valve 102 from front to back. Alternately or additionally, the opening 108 can be formed in the fluid guide 104 in such a location that gravity maintains the flap 106 in a closed position against the egress of fluid.

The one-way valve 102 may be formed in a location of the fluid guide 104 that is at least partially normal to incoming fire suppressant or other neutralizing agent. The pressure of the incoming fire suppressant/neutralizing agent may be sufficient to open the flap 106 and thereby pass through the one-way valve 102.

Although both the flap 106 and opening 108 are depicted in FIG. 1 as having a rectangular shape, more generally the flap 106 and opening 108 may have virtually any shape, such as circular, triangular, hexagonal, octagonal, trapezoidal, oval, or the like or any combination thereof. Moreover, while the flap 106 and opening 108 have the same shape, in other embodiments, the flap 106 may have a different shape as the opening 108, while the dimensions of the flap 106, no matter what the shape, are sufficient for the flap 106 to substantially cover the opening 108.

According to some embodiments, accommodation of fire suppression systems or other hazard mitigation systems in ducts or other fluid guides can be accomplished by installing or otherwise forming the one-way valve 102 in the fluid guide 104. Forming the one-way valve in the fluid guide 104 may include forming the opening 108 in the fluid guide 104, and attaching the flap 106 to the fluid guide 104 along at least a portion of a perimeter of the flap 106, such as primarily along the top side of the flap 106.

The flap 106 may be attached by any means that will allow the flap 106 to be closed except when pressure opens it to allow for entry of a fire suppressing agent, like water, gases and the like, or other neutralizing agent. For instance, the flap 106 may be sewn, riveted, adhered, welded, or otherwise affixed, along the top side of the flap, to the fluid guide 104.

In some embodiments, it may be beneficial for the flap 106 to be affixed on more than one side of its perimeter. In these and other embodiments, the flap 106 may be affixed to the fluid guide 104 along two or more of its sides with a heat-sensitive adhesive. The heat-sensitive adhesive may be configured to melt and thereby release the flap 106 from the fluid guide 104 in response to being exposed to a temperature above a predetermined temperature. Alternately or additionally, the flap 106 may be made from a heat-sensitive material that is configured to melt in response to being exposed to a temperature above a predetermined temperature.

Figure 2:
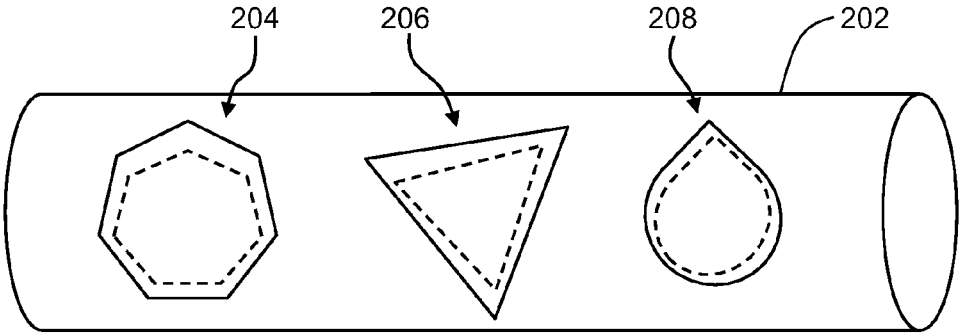
FIG. 2 illustrates a fluid guide such as a cylindrical duct in which one or more one-way valves may be implemented.

FIG. 2 illustrates a fluid guide 202 such as a cylindrical duct in which one or more one-way valves may be implemented, arranged in accordance with at least some embodiments described herein. In general, the embodiments described herein can be implemented in fluid guides having any shape and configuration, such as the barrier-type fluid guide 104, and the cylindrical duct 202 of FIG. 2. FIG. 2 further illustrates one-way valves 204, 206, 208 having a variety of shapes, including a heptagonal one-way valve 204, a triangular one-way valve 206, and a tear-shaped valve 208.

One-way valves according to some embodiments may be configured: 1) to prevent cool air within a duct system from escaping during normal operation of the duct system, and 2) to allow fire suppressants or other neutralizing agents to enter and/or cross the duct system when the fire suppression system is activated.

Figure 3A:
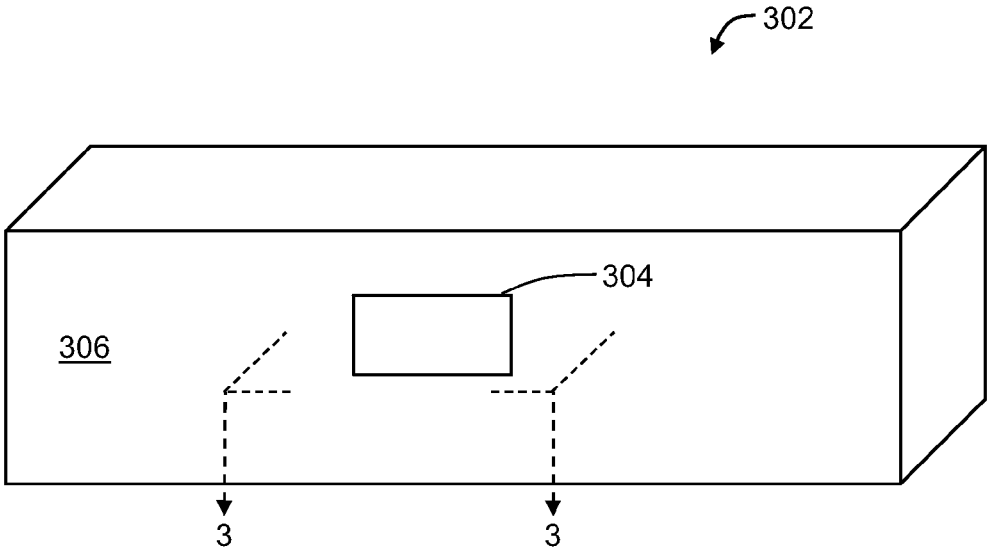
FIG. 3A illustrates an example of a fluid guide including at least one one-way valve formed on one side thereof.

For example, FIG. 3A illustrates an example of a fluid guide 302 including at least one one-way valve 304 formed on one side thereof, arranged in accordance with at least some embodiments. In more detail, the fluid guide 302 of FIG. 3A is a duct having a square or rectangular cross-sectional shape, with the one-way valve 304 formed in a front surface 306 of the fluid guide 302.

Figure 3B:
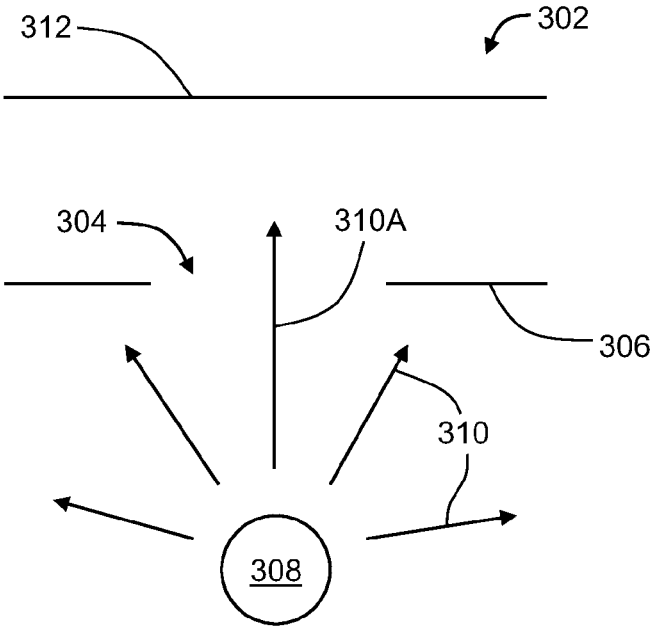
FIG. 3B is a cross-sectional view of a first embodiment of the fluid guide of FIG. 3A along cutting plane 3 in FIG. 3A.

FIG. 3B is a cross-sectional view of a first embodiment of the fluid guide 302 of FIG. 3A along cutting plane 3 shown in FIG. 3A. In the example of FIG. 3B, the fluid guide 302 includes a single one-way valve 304 formed therein in the front surface 306. The one-way valve 304 is depicted in FIG. 3B as being in an open state, which may occur in response to a neutralizing agent source 308 dispensing pressurized neutralizing agent, denoted at 310. Accordingly, when the neutralizing agent 310 is dispensed, the force from the neutralizing agent 310 may be sufficient to displace a flap of the one-way valve 304 or otherwise cause the one-way valve 304 to open such that at least a portion 310A of the neutralizing agent enters the fluid guide 302 where it may be circulated through at least a portion of the fluid guide 302.

FIG. 3B further illustrates a back surface 312 of the fluid guide 302. While the fluid guide 302 also includes a bottom surface, the bottom surface has been omitted in FIG. 3B, as well as in FIG. 3C, to avoid obscuring aspects of some example embodiments.

Figure 3C:
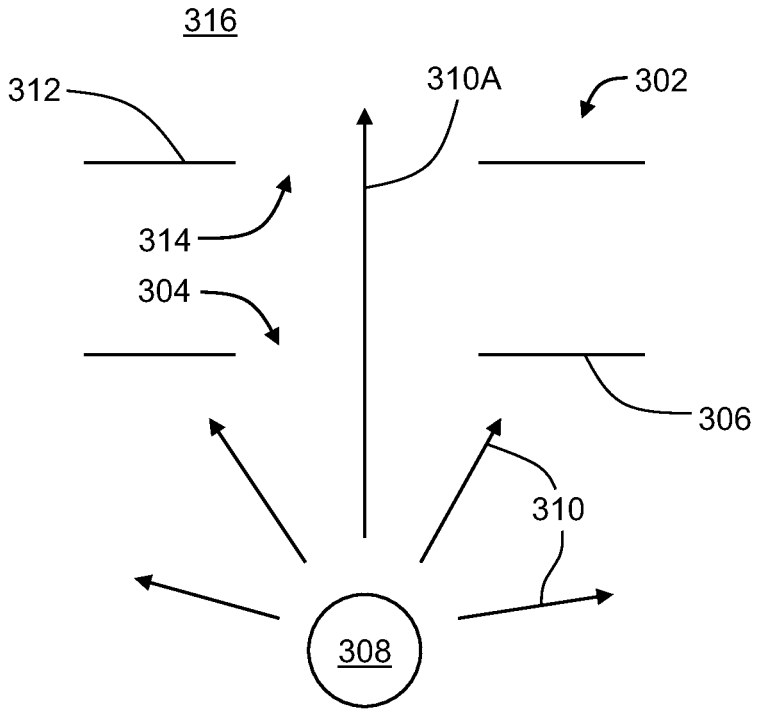
FIG. 3C is a cross-sectional view of a second embodiment of the fluid guide of FIG. 3A along cutting plane 3 in FIG. 3A.

FIG. 3C is a cross-sectional view of a second embodiment of the fluid guide 302 of FIG. 3A along cutting plane 3 shown in FIG. 3A. In the example of FIG. 3C, the fluid guide 302 includes the one-way valve 304 formed in the front surface 306, as well as another one-way valve 314 formed in the back surface 312; both one-way valves 304, 314 are depicted in an open state which may occur in response to the neutralizing agent source 308 dispensing the pressurized neutralizing agent 310. In the example of FIG. 3C, the one-way valves 304 and 314 are formed in opposing surfaces or sides of the fluid guide 302.

Optionally, the one-way valves 304, 314 may be radially aligned with each other relative to the neutralizing agent source 308 such that at least a portion 310A of the neutralizing agent 310 that passes through the one-way valve 304 in the front surface 306 may also pass through the one-way valve 314 in the back surface 306 of fluid guide 302 and reach an isolated or semi-isolated area 316 located behind the fluid guide 302. Accordingly, the neutralizing-agent 310 can still be provided to the area 316 while the fluid guide 302 can be provided to, e.g., improve cooling efficiency in a data center.

Figure 4:
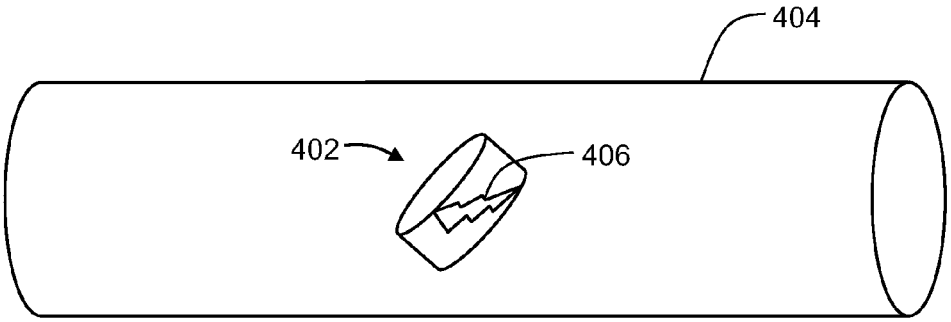
FIG. 4 illustrates an example of a one-way valve implemented as an active device.

Some embodiments described herein, such as FIG. 1, include a one-way valve 102 implemented as a passive device. Other embodiments include a one-way valve implemented as an active device. For instance, FIG. 4 illustrates an example of a one-way valve 402 formed in a fluid guide 404 and implemented as an active device, arranged in accordance with at least some embodiments described herein. In particular, the one-way valve 402 of FIG. 4 includes electronic controls 406 that may be in electrical communication with one or more sensors (not shown) and/or a control system (not shown). The electronic controls 406 may be configured to open (or close) the one-way valve 402 in response to one or more signals received from the sensors and/or the control system.

Figure 5:
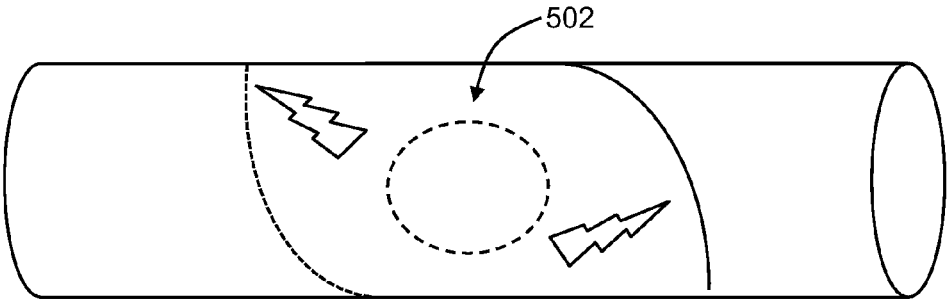
FIG. 5 illustrates an example embodiment including one or more one-way valves with one or more sensors configured to detect the presence of one or more contaminants within petroleum or water lines.

While some of the embodiments disclosed herein have been described in the context of data centers, other embodiments may be implemented in other environments and industrial systems. The other environments/industrial systems include, but are not limited to, petroleum, water, and/or other fluid transport systems. For example, FIG. 5 illustrates an example including one or more one-way valves 502 with one or more sensors configured to detect the presence of one or more contaminants, e.g., air or water contaminants, within petroleum or water lines in the field or in a transport vehicle. The one-way valve 502 may be used to dispense a neutralizing agent from within it into a plenum system in order to prevent or reduce damage. Alternately or additionally, the one-way valve 502 may be configured to allow a neutralizing agent to be dispersed therethrough while also alerting a control system and/or shutting down a segment of the plenum.

In some embodiments, a one-way valve is provided that is configured to detect one or more elements, e.g., a contaminant, that may indicate a crisis situation in a building, and either: 1) generate an alert and open to disperse a neutralizing agent into a plenum; 2) generate an alert and close so as to prevent further entry of the detected element into the plenum; and 3) open and/or close without generating an alert to allow for hazard mitigation. The generated alert may be provided to a control system to which the one-way valve is communicative coupled.

Figure 6:
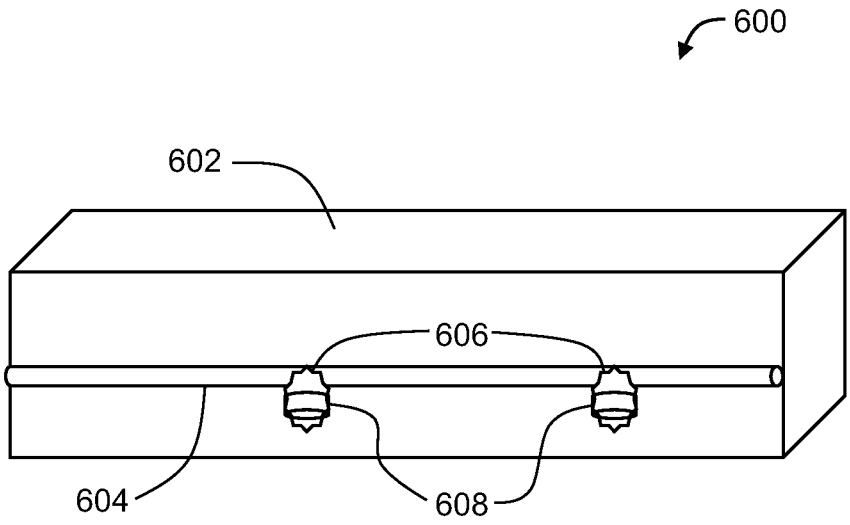
FIG. 6 illustrates an integrated fire suppression and duct system 600.

FIG. 6 illustrates an integrated fire suppression and duct system 600 according to yet another embodiment. The integrated fire suppression and duct system 600 includes one or more ducts 602 having one or more fire suppression channels 604. The fire suppression channels 604 may be integrally formed in a wall of the duct 602 or may include discrete components secured to the wall or walls of the duct 602. The fire suppression channels 604 may be configured to carry fire suppressant. One or more sensors 606 and/or valves 608 may be attached to or included with the fire channels 604. The sensors 606 may include temperature sensors and/or may be otherwise configured to detect fires. The one-way valves 608 may be configured to open in response to a signal received from the sensors 606 to dispense fire suppressant carried by the fire suppression channels 604 into an interior of the duct 602 and/or into an exterior region adjacent to and/or surrounding the duct 602.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of accommodating a hazard mitigation system in a data center cooling system that includes a duct that directs cooling fluid to a heat-generating component of a data center, the method comprising:

forming a one-way valve in a fluid-confining surface of the duct, including:

forming an opening in the fluid-confining surface of the duct; and attaching a flap to the fluid-confining surface of the duct along at least a portion of a perimeter of the flap, the flap being oversized with respect to the opening;

wherein:

during normal operation of the data center, the duct is configured to circulate cooling fluid to the heat-generating component to collect and carry away heat from the heat-generating component as it generates heat during normal operation of the heat-generating component;

the one-way valve is configured to substantially prevent the egress of the cooling fluid from the duct through the one-way valve during normal operation;

the one-way valve is configured to allow ingress of a neutralizing agent supplied by a source outside the duct through the one-way valve; and the neutralizing agent is different than the cooling fluid.

2. The method of claim 1, wherein the duct and the flap comprise at least one of metal or fabric.

3. The method of claim 1, wherein attaching the flap to the fluid-confining surface of the duct comprises at least one of sewing, riveting, adhering, or welding the flap to the fluid-confining surface of the duct.

4. The method of claim 1, wherein attaching the flap to the fluid-confining surface of the duct comprises adhering the flap to the fluid-confining surface of the duct along two or more sides of the flap using a heat-sensitive adhesive, wherein the heat-sensitive adhesive is configured to release the flap from the fluid-confining surface of the duct in response to being exposed to a temperature above a predetermined temperature.

5. The method of claim 1, wherein the hazard mitigation system comprises a fire suppression system.

6. The method of claim 5, wherein the neutralizing agent comprises fire suppressant.

7. The method of claim 1, wherein the one-way valve comprises a first one-way valve, the method further comprising forming a second one-way valve on a second side of the duct opposite a first side of the duct on which the first one-way valve is formed.

8. The method of claim 7, wherein the first and second one-way valves are radially aligned with each other relative to a pressurized source of neutralizing agent.

9. The method of claim 1, further comprising providing electronic controls for electronically opening the one-way valve.

10. The method of claim 1, wherein the cooling fluid comprises air and the neutralizing agent comprises fire suppressant.

11. A method of accommodating a hazard mitigation system in a data center cooling system that includes a duct that directs cooling fluid to a heat-generating component of a data center, the method comprising:

forming a first one-way valve in a first fluid-confining surface of the duct;

forming a second one-way valve in a second fluid-confining surface of the duct that is opposite the first fluid-confining surface of the duct, wherein the first and second one-way valves are radially aligned with each other relative to a pressurized source of neutralizing agent located outside the duct;

wherein:

during normal operation of the data center, the duct is configured to circulate cooling fluid to the heat-generating component to collect and carry away heat from the heat-generating component as it generates heat during normal operation of the heat-generating component;

the one-way valve is configured to substantially prevent the egress of the cooling fluid from the duct through the one-way valve during normal operation;

the one-way valve is configured to allow ingress of a neutralizing agent supplied by the pressurized source through the one-way valve; and the cooling fluid comprises air and the neutralizing agent comprises fire suppressant.

12. The method of claim 11, wherein forming the first one-way valve in the first fluid-confining surface of the duct comprises:

forming an opening in the first fluid-confining surface of the duct; and attaching a flap to the first fluid-confining surface of the duct along at least a portion of a perimeter of the flap, the flap being oversized with respect to the opening.

* * * * *